US006186448B1

(12) United States Patent
Wydotis et al.

(10) Patent No.: US 6,186,448 B1
(45) Date of Patent: Feb. 13, 2001

(54) CAPTIVITY POINT DETECTION SYSTEM WITH SINGLE SWITCH POSITION TARGET

(75) Inventors: Leonard M. Wydotis, Seven Fields, PA (US); Daniel H. Brushwood, Saluda, SC (US)

(73) Assignee: Union Switch & Signal, Inc., Pittsburgh, PA (US)

( * ) Notice: Under 35 U.S.C. 154(b), the term of this patent shall be extended for 0 days.

(21) Appl. No.: 09/149,195

(22) Filed: Sep. 8, 1998

(51) Int. Cl.[7] ..... E01B 7/00
(52) U.S. Cl. ..... 246/220; 246/401; 246/476
(58) Field of Search ..... 246/220, 219, 246/218, 260, 476, 401, 253, 448

(56) References Cited

U.S. PATENT DOCUMENTS

| | | | | |
|---|---|---|---|---|
| 4,896,850 | * | 1/1990 | Carmes | 246/476 |
| 4,921,189 | * | 5/1990 | Callegari | 246/448 |
| 5,116,006 | | 5/1992 | Ocampo | 246/220 |
| 5,192,038 | | 3/1993 | Ocampo | 246/220 |
| 5,504,405 | | 4/1996 | Hager | 318/439 |
| 5,669,587 | | 9/1997 | Van Alstine et al. | 246/220 |
| 5,806,809 | * | 9/1998 | Danner | 246/220 |

OTHER PUBLICATIONS

New Product Information Brochure entitled "Solid State Switch Monitoring System" from J&A Industries, Inc., Kansas City, KS, undated, 4 pages (no date).

Service Manual No. 6263 for M–3, M–23A, M23–B Electric Switch Machines with Permanent Magnet Motor, Copyright 1992, Union Switch & Signal Inc.

* cited by examiner

*Primary Examiner*—Mark T. Le
(74) *Attorney, Agent, or Firm*—David V. Radack; Kirk D. Houser; Eckert Seamans Cherin & Mellott, LLC

(57) ABSTRACT

A point detection system is provided for use in a typical switch machine with a typical indication system, wherein a point detector bar is slidably captivated within a point detector sleeve, and wherein a target that is integrally engaged with the point detector bar is sensed by at least one sensing device, thereby to detect movement of the point detector bar. The point detector sleeve is supported by a track side bearing affixed to a track side wall of the switch machine, and by a field side bearing affixed to an opposing wall of the switch machine. The point detector bar extends outside the switch machine from only the track side bearing, thereby eliminating the bearings and the pinch point between the hand throw lever and the two piece point detector bar that otherwise extended from the related art switch machine. The sensing device may be mounted upon a slide mechanism to adjust the sensing device relative to the target. Use of the sensing device eliminates the need for cams to monitor in order to detect movement of the point detector bar, as well as eliminates moving parts between the cams and the mechanical linkages. Further, at least one other sensing device detects a normal and reverse locked position of a lock bar assembly and lock box of the switch machine.

33 Claims, 5 Drawing Sheets

CAPTIVITY POINT DETECTION SYSTEM WITH SINGLE SWITCH POSITION TARGET

CROSS REFERENCE TO RELATED APPLICATION

Reference is made to U.S. patent application Ser. No. 09/120,610, filed on Jul. 22, 1998, titled RAILWAY SWITCH CIRCUIT CONTROLLER, which relates to art similar to the present invention and is commonly owned by the applicant.

BACKGROUND OF THE INVENTION

1. Field of the Invention

The present invention relates generally to an electric motor driven switch machine for switching railroad tracks so that trains may switch from one track to another. More particularly, the present invention relates to a captive point detection system of a switch machine, for detecting, with a single switch position target, whether a railroad track has been properly switched, in order that such detection may indicated by indication means positioned locally at the switch machine or at a remote location.

2. Description of the Related Art

As is known in the art, a common method for switching a train from one railroad track to another is to install an electric motor driven switch machine next to a switching point of the track. Since modern versions of these switch machines are usually operated from a remote location, it is essential that a remote operator be able to determine that the switch has, in fact, been thrown as requested. Moreover, because switch point closure is imperative to safe railroad train operation, Federal Railroad Administration (FRA) rules and regulations mandate not only that the position of the switch points be mechanically locked to prevent the points from opening during train traffic, but also that the locked position of the switch points be continuously monitored to detect any undesirable movement. A circuit controller that includes a point detection system as an integral part of either a mainline switch machine or a stand-alone unit is used to accomplish this type of switch point monitoring, detection and subsequent indication to the switch machine or remote location.

A related art point detection and indication system is described by U.S. Pat. No. 5,669,587, issued Sep. 23, 1997 in the name of Van Alstine et al, which is hereby incorporated by reference in its entirety. In the Van Alstine et al. reference, there is provided an electric motor driven switch machine for positioning a railroad track at a switching point having rail point detection and indication mechanism. In particular, the detection and indication mechanism has a latch out mechanism that identifies a latch out condition when the railroad tracks are not at, or near, their proper positions before or after switching the railroad tracks. The detection and indication mechanism includes a four bar linkage which comprises a point detector bar, two cam followers, and a link arm assembly. The cam followers, supported in part by the link arm assembly, are connected to two point detector switches, so that the switch machine is operating when either one of these switches is closed or the railroad tracks are being switched.

Referring now to FIG. 1 herein, there is shown an overhead planar view of a typical related art point detection and indication system 100 housed within a portion of a switch machine 105, wherein a cover (not shown) of the switch machine 105 has been omitted from the figure. As is commonly known, the switch machine 105 is located adjacent to a set of stock rails having a set of switching rails situated therebetween (not shown). The general structure and positioning of switch machines relative to railroad tracks is known in the art and therefore, is not described in detail.

In the related art, a hand throw lever 110 (partially shown in phantom) is connected to a gear box (not shown) and is utilized typically for manual operation of the switch machine 105. Of the various components of the switch machine 105, only the base 115 of the switch machine 105 and the elements relevant to the operation of the related art detection and indication system 100 are shown. The basic design of the related art detection and indication system 100 typically includes a point detector bar 120 and adjacent normal and reverse cam followers 125, 130, respectively, which are generally each physically connected to mechanical linkages 135.

As is known in the art, the point detector bar 120 is a long cylindrical rod positioned perpendicular across the longitudinal axis of the switch machine 105 such that movement by the point detector bar 120 corresponds to movement by switching rails relative to the position of stock rail on either side (not shown). The point detector bar 120 typically passes through a wall 122 and a wall 124 of the switch machine 105. In FIG. 1, the wall 122 faces toward the railroad track (not shown) on a track side 140 and the wall 124 faces away from the railroad track on a field side 145. Typically, the point detector bar 120 is held in place with threaded adjustment bushings 150, 155, and a movable adjustment sleeve 160 that extends outwardly from the wall 122 and the wall 124 into the track side 140 and the field side 145, respectively. The point detector bar 120 is capable of moving in two opposing directions: a normal direction 165 and a reverse direction 170. When the point detector bar 120 is moving upward in FIG. 1 toward the railroad tracks (not shown) on the track side 140 of the switch machine 105, the bar is moving in the reverse direction 170; when the point detector bar 120 is moving downward in FIG. 1 toward the field side 145 of the switch machine 105, the bar is moving in the normal direction 165. Typically, a reverse cam 175 is defined at a fixed position on the point detector bar 120 and a normal cam 178 is defined by the movable adjustment sleeve 160 such that the detection and indication system 100 of the related art can identify movement by the switching rails by monitoring the position of the reverse cam 175 with the reverse cam follower 130 and the normal cam 178 with the normal cam follower 125.

A common problem in the related art electro-mechanical type point detection and indication systems is slack or lost motion in the mechanism that results due to wear over time. Related art point detection and indication systems of an electro-mechanical type typically detect the position of the point detector bar and related locking device using mechanical linkages to operate mechanical contacts, micro-switches, rotary switches, or a similar device. Over time, the mechanical linkages wear, thereby creating slack or lost motion in the mechanism. With undesired slack or lost motion, if the point detector bar should move unintentionally, thereby indicating unsafe switch point movement, the mechanical linkages detecting the internal point detector bar must move a given distance to take up or absorb the lost motion before the mechanical contacts or similar devices are actuated. The result is decreased sensitivity in switch point monitoring, which ultimately may cause an undesirable safety hazard.

Another problem with related art point detection and indication systems is that their design commonly requires the point detector bar to protrude out both sides of the switch machine. The protrusion of the point detector bar typically causes interference with the manual hand throw lever on dual controlled mechanisms. Interference between the hand throw lever and the protrusion of the internal point detector bar creates a pinch point 180 for a manual operator's hands, which is a safety hazard.

Another problem with related art point detection and indication systems is the complex manner that is required for adjusting a two-piece point detector bar that is connected to the switch machine and the track. As shown in FIG. 1, the two-piece point detector bar comprising point detector bar 120 and movable adjustment sleeve 160 typically passes through and is held in place by the bearings 150, 155. The point detector bar 120 is located on the track side 140 of the switch machine 105, and the movable adjustment sleeve 160 is located on the opposing track side 145 of the switch machine 105. The point detector bar 120 must be adjusted first at the fixed independent field side 140 of the switch machine, and then the movable adjustment sleeve 160 must be adjusted, thereby to align the cam followers 125, 130 and the mechanical linkages 135 to detect properly the normal cam 178 and the reverse cam 175, respectively. The complexity associated with adjusting the related art point detection systems requires a certain level of highly skilled and mechanically-inclined personnel to work on these devices. Maintaining a staff of highly skilled people is very costly to the railroads, and train operations typically become jeopardized by high personnel turnover rates and unavailability of personnel.

Consequently, a need exists for a point detection system that may be utilized with indication means, such as a related art circuit controller, for instance, wherein the point detection system minimizes the problems associated with: the slack or lost motion that results due to wear over time in the related art electro-mechanical type point detection systems; the point detection bar that protrudes from both sides of the switch machine; and the complex manner of adjusting related art two-piece point detection bars in a specified sequence.

SUMMARY OF THE INVENTION

It is therefore an object of the present invention to provide an improved point detection system for use with indication means in a railway switch machine.

Another object of the present invention is to provide a point detection system having a simple design so that it is economical to manufacture and maintain.

A further object of the present invention is to provide a point detection system having a simple, durable, reliable, and economical design that ensures that a "safe condition" will not be indicated by a cooperating indication system when the point detector bar and a lock box are not in correspondence with each other.

It is a feature of the present invention to captivate the point detecting bar within an elongated sleeve internal to the switch machine, such that the bar protrudes from only one side of the switch machine and is maintained and is slidably adjustable through the one side and within the elongated sleeve.

It is another feature of the present invention to detect the position of the point detecting bar with detection means, such a proximity sensor, for instance, that senses a target that is affixed to or otherwise integrally engaged with the bar.

In accordance with a preferred embodiment of the present invention, a point detection system is provided for use in a typical switch machine with a typical indication system, wherein a point detector bar is slidably captivated within a point detector sleeve, and wherein a target that is integrally engaged with the point detector bar is sensed by at least one sensing device, thereby to detect movement of the point detector bar. The point detector sleeve preferably extends the internal width of the controller housing within the switch machine. The point detector sleeve is supported by a track side bearing affixed to a track side wall of the switch machine, and by a field side bearing affixed to an opposing wall of the switch machine. The point detector bar extends outside the switch machine from only the track side bearing, thereby eliminating the bearings and the pinch point between the hand throw lever and the two piece point detector bar that otherwise extended from the related art switch machine. Preferably, the track side bearing and field side bearing is interchangable, thereby to facilitate changing the physical orientation of the switch machine relative to the railroad tracks. The sensing device may be mounted upon a slide mechanism to adjust the sensing device relative to the target. Use of the sensing device eliminates the need for cams to monitor in order to detect movement of the point detector bar, as well as eliminates moving parts between the cams and the mechanical linkages. Further, at least one other sensing device detects a normal and reverse locked position of a lock bar assembly and lock box of the switch machine.

Briefly described according to a preferred embodiment of the present invention, a point detection system for a railway switch machine defining a housing with a first side wall and an opposing second side wall, wherein the point detection system comprises: a point detector bar with a first and second end, positionable in a normal point position and a reverse point position; a slide bar cooperatively engaged within the housing with locking means for locking movement of the switch machine, the slide bar being lockable in a normal locked position and a reverse locked position; a support sleeve affixed within the housing to the first side wall and to the opposing second side wall, for receiving and slidably supporting the first end of the point detector bar therewithin; an orifice defined in the first side wall of the housing, through which the point detector bar is slidably retained by the first side wall, such that the first end of the point detector bar is slidably captivated within the support sleeve within the housing and the second end of the point detector bar is positioned outside of the housing; a point detector target integrally engaged with the first end of the point detector bar within the housing; a slide bar target integrally engaged with the slide bar within the housing; first point detecting means for detecting the point detector target when the point detector bar is positioned in the normal point position, wherein the first point detecting means generates a normal point detection signal when the point detector target is detected in the normal point position; and first lock detecting means for detecting the slide bar target when the slide bar is locked in the normal locked position, wherein the first lock detecting means generates a normal lock detection signal when the first lock detecting means detects the slide bar target.

An advantage of the present invention is that mechanical linkages that touch or otherwise link to the point detecting bar are reduced or otherwise eliminated, thereby to improve detection sensitivity by minimizing slack or lost motion in the mechanism that otherwise results due to wear over time.

Another advantage of the present invention is that adjustment and calibration of the point detection bar relative to the switch machine is simplified with adjustment of at least one movable sensor relative to the target affixed to the bar, rather than adjustment of the bar relative to the switch machine and the switch point.

Another advantage of the present invention is increased reliability, user-friendliness and simplicity of using, maintaining and troubleshooting, due to fewer moving parts and mechanical linkages to wear out or otherwise fail, thereby decreasing maintenance and operating costs for the user.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
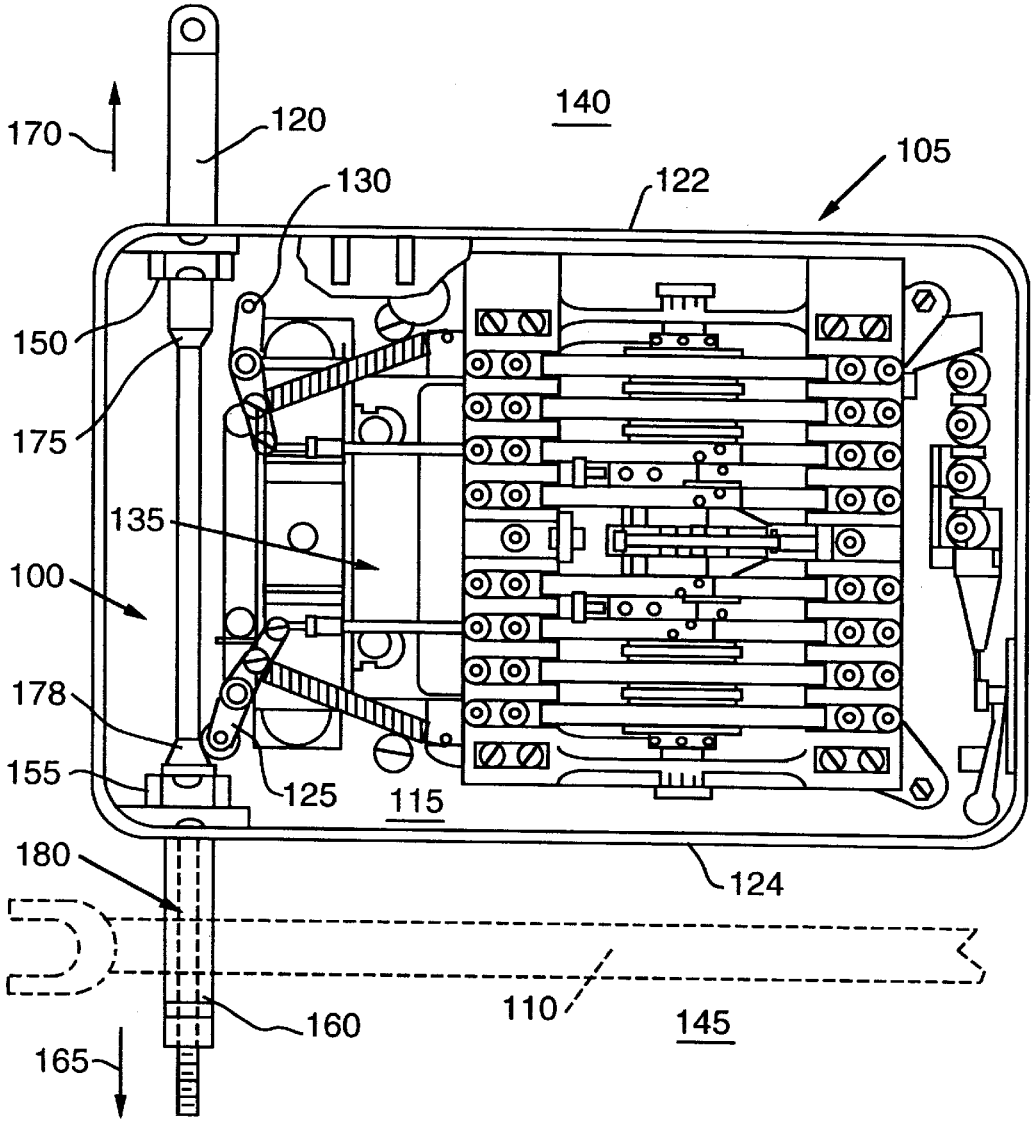
FIG. 1 Prior Art
FIG. 1 is a top view of a prior art point detection and indication system, showing pinch point interference of a hand throw lever (phantom) with a protruding point detecting bar.
Figure 2:
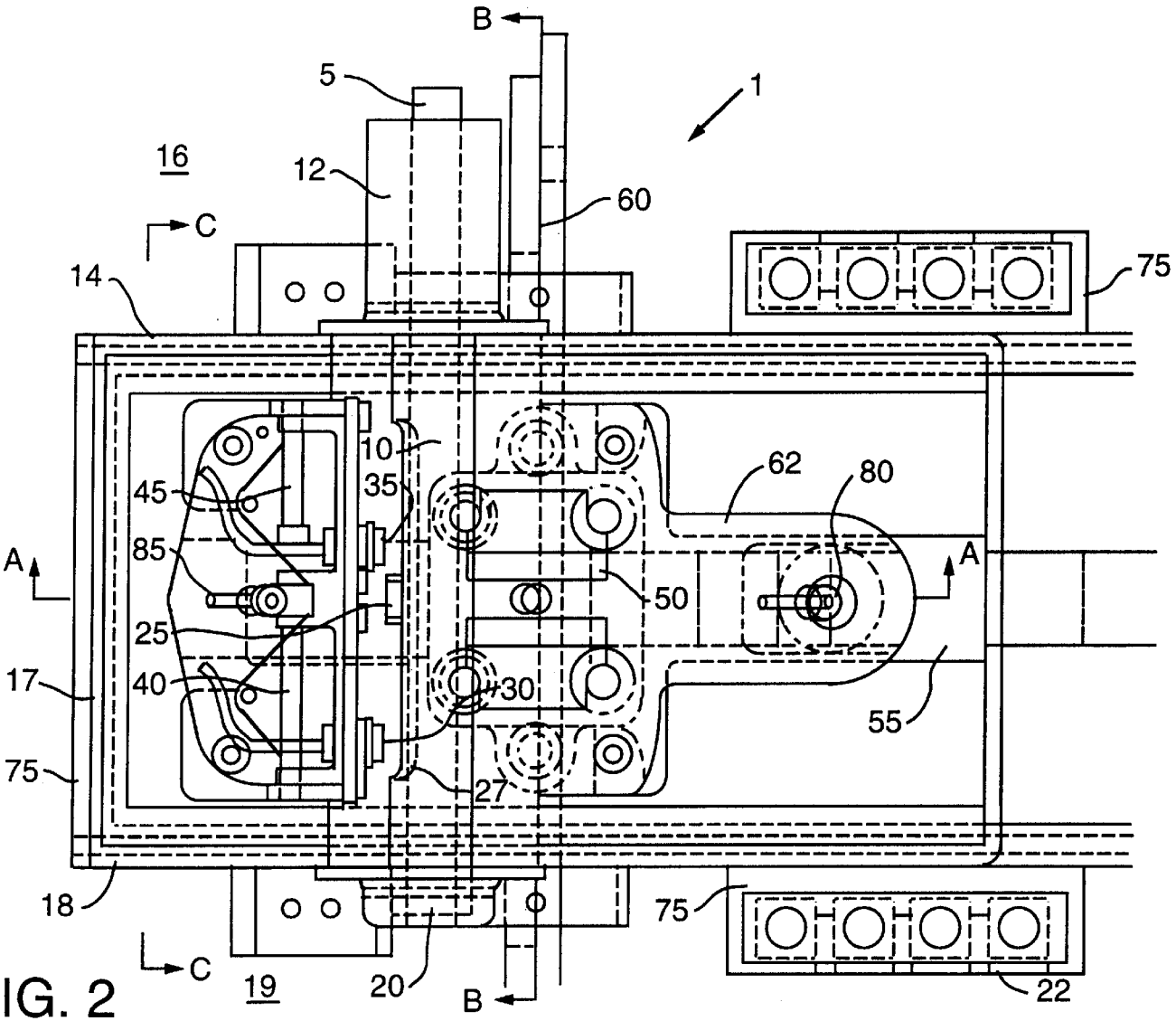
FIG. 2 is a top view of a point detection system in accordance with a preferred embodiment of the present invention.

Referring to FIGS. 2 through 5 and, in particular, FIG. 2, a top planar view of a point detection system 1 is shown in accordance with a preferred embodiment of the present invention. A point detector bar 5 (shown partially in phantom in FIG. 2) may be held slidably captive within a point detector sleeve 10 and within a track side bearing 12 mounted to a wall 14 on a track side 16 of a controller housing 17, thereby to support the point detector sleeve 10 and the point detector bar 5. In a preferred embodiment, the point detector sleeve 10 may extend the internal width of the controller housing 17 between the wall 14 and a wall 18 on a field side 19 of the controller housing 17, as shown in FIG. 2. A field side bearing 20 may be mounted to the wall 18 and may support the point detector sleeve 10. A point detector target 25 may be affixed to the point detector bar 5 and may be exposed to be detected or sensed through a slot 27 defined in the captive point detector sleeve 10. The slidable captivation of the point detector bar 5 within the track side bearing 12 and within the point detector sleeve 10 positioned within the controller housing eliminates the need for the bearings 150, 155 of the related art (see FIG. 1).

The point detector bar 5 may be positioned in a normal position and a reverse position. The normal position may be indicated when the point detector bar 5 extends into the point detector sleeve 10 such that the point detector target is more toward the bottom of the slot 27 shown in FIG. 2. A normal point detection device 30 may detect the point detector target 25, thereby to indicate the normal position of the point detector bar 5.

Similarly, the reverse position may be indicated when the point detector bar 5 extends partially into the point detector sleeve 10 such that the point detector target is more toward the top of the slot 27 shown in FIG. 2. A reverse point detection device 35 may detect the point detector target 25, thereby to indicate the reverse position of the point detector bar 5. FIG. 2 shows the point detector target 25 and affixed point detector bar 5 positioned between the normal and reverse position but closer to reverse position due to the proximity of the point detector target 25 to the reverse point detection device 35. One skilled in the art will understand a potential need for linear adjustment of the normal and reverse point detection devices 30, 35 due to a range of possibilities for the normal and reverse positions between the slot 27 for a variety of point detector bar 5 connections to various types of switch points (not shown).

As such, the normal point detection device 30 may be held by a normal linear slide 40, thereby to permit a linear position adjustment of normal point detection device 30 with respect to the point detector target 25 in the normal position. Similarly, the reverse point detection device 35 may be held by a reverse linear slide 45, thereby to permit a linear position adjustment of the reverse point detection device 35 with respect to point detector target 25 in the reverse position. Linear slides 40, 45 may be a commonly known, commercially available linear slide mechanism. In a preferred embodiment, linear slides that are designed to mount and adjust an inductive proximity sensor may be used, for instance.

Figure 3:
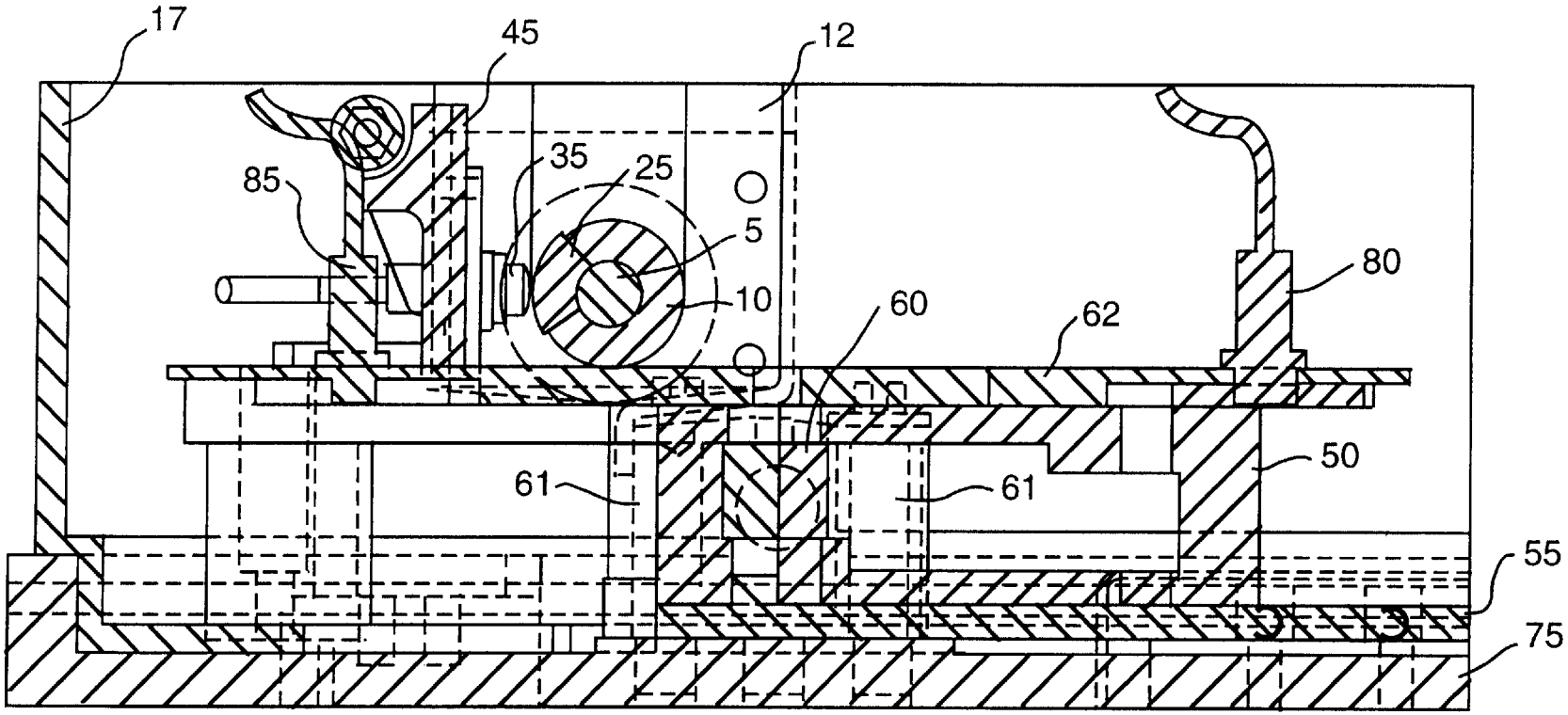
FIG. 3 is a cross-sectional side view taken along the lines A—A of FIG. 2.
Figure 4:
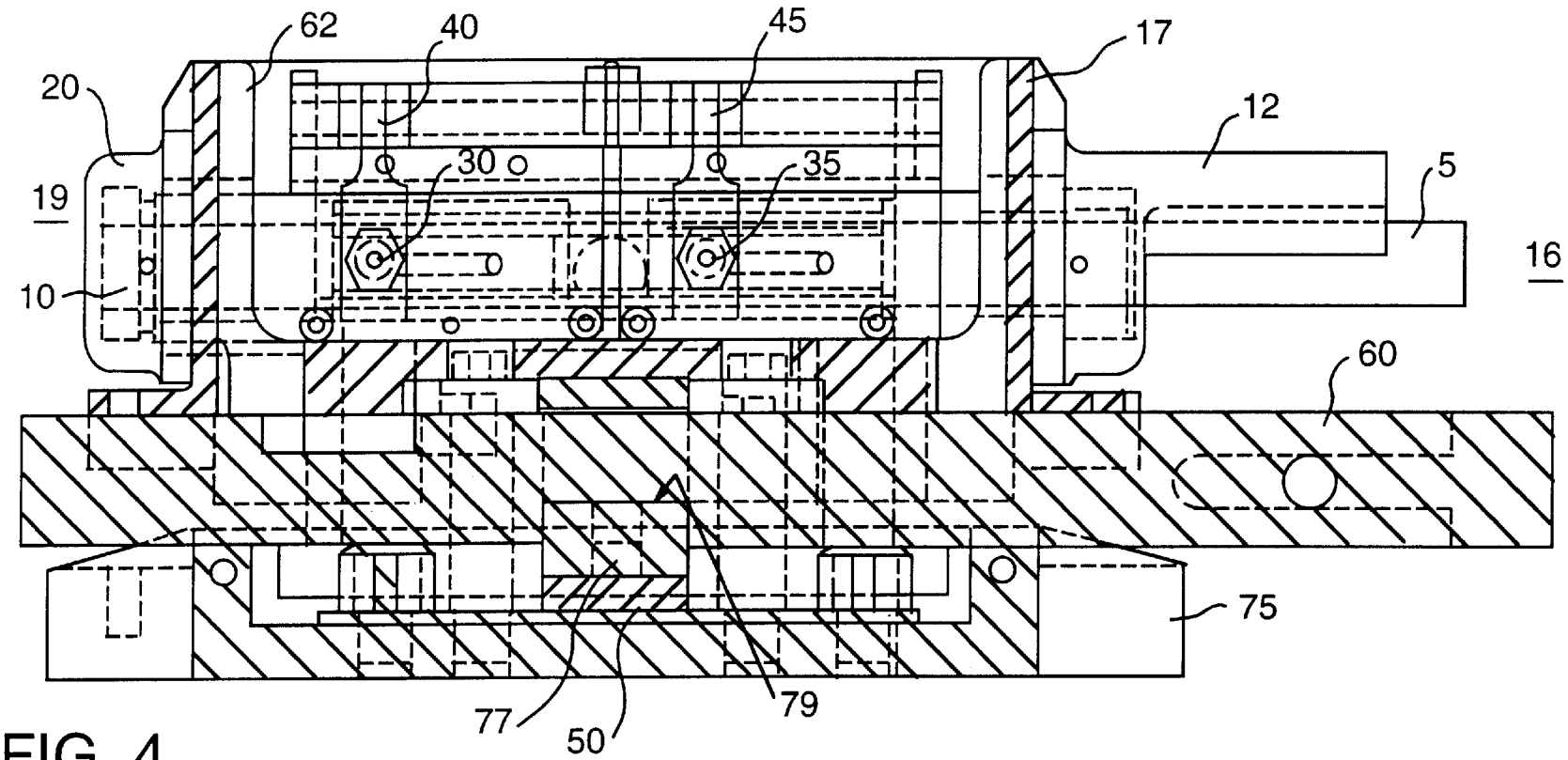
FIG. 4 is a cross-sectional front view taken along the lines B—B of FIG. 2.

As shown in FIGS. 2, 3 and 4, a commonly known lock box 50 that is fixedly mounted to a slide bar 55 mechanically cooperates with a commonly known lock rod assembly 60 to mechanically lock the switch points (not shown). The lock rod assembly 60 rides between and is guided by typical lock rod rollers 61 (see FIG. 3). The slide bar 55 rides atop and is guided by a switch machine base 75 through the controller housing 17 and beneath a frog plate 62 within the controller housing 17. In a preferred embodiment, the track side bearing 12 and the field side bearing 20 may be mounted directly to the frog plate 62. The slide bar 55 moves linearly along the length of the switch machine base 75 as the switch machine operates, thereby moving the lock box 50, which is fixedly mounted to the slide bar 55, in the same linear fashion. The lock box 50 has a locking dog 77 (see FIG. 4) that inserts into a locking notch 79 (see FIG. 4) in the lock rod assembly 60 to mechanically prevent the lock rod assembly 60 from moving linearly in a motion perpendicular to the switch machine and the stock rail. This commonly known locking method is typically safety critical; as such, it becomes necessary to detect the linear position of the lock box 50 in order to insure it is adequately locking the lock rod assembly 60.

A normal locking detection device 80 and reverse locking detection device 85 may be mounted vertically through and fastened to the frog plate 62, thereby to sense or detect the linear position of lock box 50 along the length of the switch machine base 75. The lock box 50 may be locked in a normal locked position and a reverse locked position. Preferably, the normal locking device 80 detects the lock box 50 when the switch machine is locked in the normal position and the reverse locking device 85 will detect the proper position of the lock box 50 when the switch machine is locked in the reverse position. FIG. 3 shows the lock box 50 locked in the normal locked position wherein the right edge of the lock box 50 is proximally located beneath the normal locking detection device 80; alternately, the lock box 50 may be locked in the reverse locked position wherein the left edge of the lock box 50 in FIG. 3 is proximally located beneath the reverse locking detection device 85. In a preferred embodiment, the detection devices 80, 85 each may be a typical electronic proximity sensor or a typical mechanical micro-switch, or similar device. In a preferred embodiment, the detection devices 80, 85 each may be an inductive proximity sensor used to detect the lock box 50, which is typically made of a high strength ferrous metal. It is contemplated that the lock box 50 itself may be detected by the detection devices 80, 85. Alternately, it is contemplated that a lock target (not shown) may be integrally engaged with the lock box, in order that the detection devices 80, 85 may detect the lock target. One skilled in the art will recognize that an optical target, such as a bar code or reflective paint, may be applied to the point detector bar 5 or the lock box 50, thereby to be detectable by a suitable optical sensor, such as a bar code scanner, for instance.

It is contemplated to mount the normal locking detection device 80 and the reverse locking detection device 85 in similar linear slides and in a similar manner to the manner in which the normal point detection device 30 and the reverse point detection device 35 are respectively mounted to the normal linear slide 40 and the reverse linear slide 45, thereby to permit a linear position adjustment of the normal locking detection device 80 and the reverse locking detection device 85 with respect to the lock box 50.

FIG. 3 is a cross-sectional view taken along the lines A—A of FIG. 2. FIG. 3 more clearly shows the horizontal mounting of the reverse point detection device 35 to the reverse linear slide 45. FIG. 3 further shows the positioning of the reverse point detection device 35 relative to the point detector target 25, which is affixed to or otherwise integrally engaged with the point detector bar 5 located within the point detector sleeve 10. The normal locking detection device 80 and the reverse locking detection device 85 are shown mounted vertically within the frog plate 62. The lock box 50 is shown locked in the normal position by the lock rod assembly 60. The lock box 50 is affixed to the slide bar 55, which rides within the controller housing 17 and atop the switch machine base 75.

FIG. 4 is a cross-sectional view taken along the lines B—B of FIG. 2. FIG. 4 shows a front view of the normal point detection device 30 and the reverse point detection device 35 mounted in the normal linear slide 40 and the reverse linear slide 45, respectively. FIG. 4 further shows a side view of the point detector bar 5 within the track side bearing 12 and the point detector sleeve 10, as well as the field side bearing 20 that supports the point detector sleeve 10 and prevents protrusion of the point detector bar 5 outside of the switch machine on the field side 19. The locking dog 77 of the lock box 50 is shown cooperatively mated with the locking notch 79 in the lock bar assembly 60.

Figure 5:
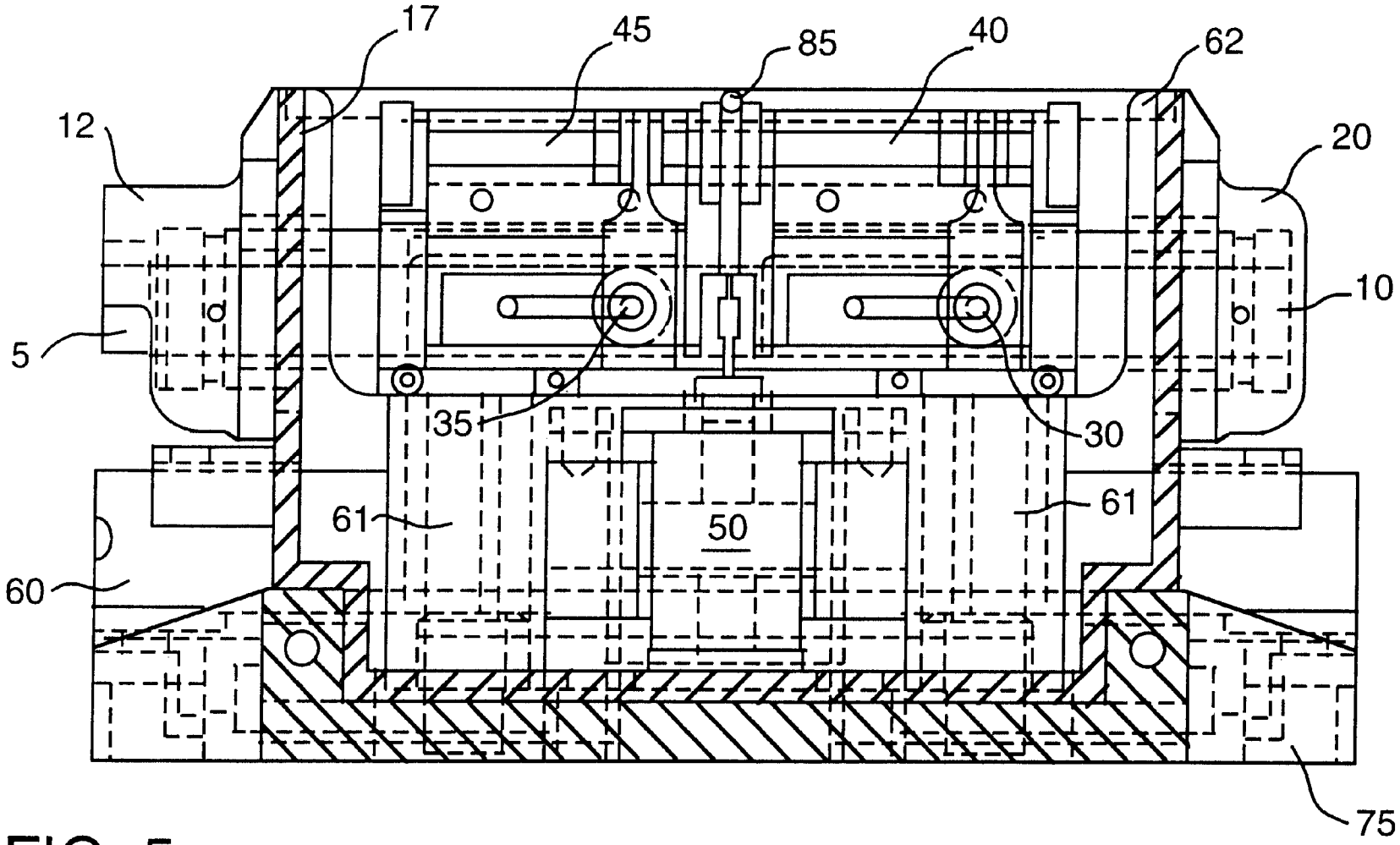
FIG. 5 is a cross-sectional rear view taken along the lines C—C of FIG. 2.

FIG. 5 is a cross-sectional view taken along the lines C—C of FIG. 2. FIG. 5 shows a rear view of the normal point detection device 30 and the reverse point detection device 35 mounted to the normal linear slide 40 and the reverse linear slide 45, respectively. A rear view of the reverse locking detection device 85 is shown between the normal linear slide 40 and the reverse linear slide 45. FIG. 5 further shows a side view of the point detector bar 5 within the track side bearing 12 and the point detector sleeve 10, as well as the field side bearing 20 that supports the point detector sleeve 10 and prevents protrusion of the point detector bar 5 outside of the switch machine on the field side 19.

2. Operation of the Preferred Embodiment

In operation, the point detector bar 5 is fixedly connected, typically externally to the switch machine, to a commonly known point detector connecting rod (not shown) that is directly connected to the track near ends of the track switch points (not shown). As the switch machine moves the switch points from the normal position to the reverse position, or vice versa, usually a distance of approximately 4 to 5 inches, the point detector connecting rod and fixedly connected point detector bar 5 is moved that same distance. The point detector bar 5 slides within the track side bearing 12 and within the point detector sleeve 10, which sleeve captivates the point detector bar 5. In a preferred embodiment, the point detector sleeve 10 is supported by the track side bearing 12 and the field side bearing 20, each of which may be mounted to the frog plate 62 with a plurality of bolts or similar fasteners (not shown). In the field, the frog plate 62 and the linear slides 40, 45 may be removed easily by removing a plurality of bolts or similar fasteners.

Because the internal point detector bar 5 may be captivated within the point detector sleeve 10 and may move in a horizontal direction perpendicular to the length of the switch machine, there is no longer a need to have the bearings 150, 155 that supported the prior art point detector bars. The prior art point detector bars not only had cams for detection, but also extended outside of the switch machine on the track side 140 and the field side 145, as shown in the prior art of FIG. 1. In a preferred embodiment of the present invention, the internal point detector bar 5 may be supported inside the switch machine with the point detector sleeve 10 and the track side bearing 12, such that the point detector bar 5 does not extend out of the switch machine on the field side 19 (refer to FIG. 2). This elimination of the protrusion of the point detector bar 5 out the field side 19 of the switch machine eliminates the pinch point safety hazard that otherwise existed between the manual hand throw lever 110 and the two-piece point detector bar comprising the point detector bar 120 and the movable adjustment sleeve 160 of the prior art in FIG. 1.

As the track switch points move a given distance, the point detector bar 5 moves that same linear distance and in turn moves point detector target 25 the same linear distance. In order to detect and insure track switch point closure, the linear position of the point detector target 25 is sensed by either the normal point detection device 30 or reverse point detection device 35 through the slot 27 defined in the point detector sleeve 10. The detection devices 30, 35 may be an electronic proximity sensor, mechanical micro-switch, or similar device. In a preferred embodiment, an inductive proximity sensor may be used, in which case point detector target 25 made of a ferrous metal would be preferable. It is contemplated that the detection devices 30, 35 may be coupled to a signal generator that may generate respective normal and reverse detection signals in response to detection of the point detector target 25 by the normal point detection device 30 and the reverse point detection device 35, respectively.

Additionally, the lock rod assembly 60 is fixedly connected, typically externally to the switch machine, near ends of the track switch points. After the switch machine has moved the track switch points from the normal position to the reverse position, or vice versa, the lock box 50 mechanically cooperates with the lock rod assembly 60 by mating the notch 79 in the lock rod assembly 60 with the dog 87 in the lock box 50, as is known in the art, thereby mechanically locking the switch points (refer to FIGS. 2, 3, and 4). In order to detect and insure locking of the track switch point closure, the linear position of the lock box 50 is sensed by either the normal locking detection device 80 or reverse locking detection device 85. The detection devices 80, 85 may be an electronic proximity sensor, mechanical micro-switch, or similar device. In a preferred embodiment, an inductive proximity sensor may be used to detect the lock box 50, which is typically made of a ferrous metal, for instance.

Proximity switches or similar devices may be used and may be adjusted along the length of the captive point detector sleeve 10 without having to adjust the internal point detector bar 5 with respect to the track location, thereby to monitor properly the position of the point detector target 25. The target which may be affixed to the internal point detector bar 5 and the bar may be ultimately connected to the switch points (not shown). The present invention eliminates mechanical linkages previously used to monitor the position of the point detector bar 5 and the lock box 50. The present invention has no moving parts that may wear between the point detector bar 5 and the point detection devices 30, 35 or the lock box 50 and the locking detection devices 80, 85.

The operational state of the point detection devices 30, 35 and the locking detection devices 80, 85 may be monitored with a microprocessor, logic controller, or similar device that integrates with the railroad's train control signaling systems, as is known in the switch circuit controller art for switch machines. In a preferred embodiment, these devices may be monitored by a vital microprocessor designed to provide fail-safe operation, for instance. It is contemplated that the point detection devices 30, 35 may each be coupled to a designated point signal generator (not shown) that may generate respective normal and reverse point detection signals in response to detection of the point detector target 25 by the normal point detection device 30 and the reverse point detection device 35, respectively. The respective normal and reverse point detection signals may be transmitted to typical indication means, such as a circuit controller, for instance, for indication to railway personnel or devices. Similarly, it is contemplated that the locking detection devices 80, 85 may each be coupled to a designated lock signal generator (not shown) that may generate respective normal and reverse lock detection signals in response to detection of the lock box 50 by the normal locking detection device 80 and the reverse locking detection device 85, respectively. The respective normal and reverse lock detection signals may be transmitted to typical indication means, such as a circuit controller, for instance, for indication to railway personnel or devices.

Moreover, it is contemplated that the switch machine may be oriented such that the wall 14 faces toward the field side 19 and the wall 18 faces toward the track side 16 by interchanging the track side bearing 12 with the field side bearing 20. In this case, the point detector bar would be received by the track side bearing 12, which is now affixed to the wall 18, and the switch machine base 75 would be placed on the opposite side of the switch points such that the wall 18 then faced toward the track side 16 and the wall 14 then faced toward the field side 19. Further, in this case, the normal point detection device 30 would detect the reverse position of the point detector bar 5, and the reverse point detection device 35 would detect the normal position of the point detector bar 5.

It is further contemplated that the point detector target 25 may be positioned near enough to the detection devices 30, 35 to physically obstruct movement of the point detector target 25, thereby requiring manual inspection and repair of the detection device that may be maladjusted so as not to be capable of properly detecting the point detector target 25.

In a preferred embodiment, a self-lubricating bearing material may be used in the manufacture of the captive point detector sleeve 10, thereby to minimize or eliminate a need for lubrication within the controller housing 17. A preferred embodiment of the present invention minimizes or eliminates a potential decreased sensitivity for detecting switch point movement and appropriate switch machine locking due to otherwise worn mechanical parts.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims that follow.

What is claimed is:

1. A point detection system for a railway switch machine, said railway switch machine having a housing defining a first side wall and an opposing second side wall, and a slide bar positionable in a normal locked position and a reverse locked position, wherein said point detection system comprises:

a point detector bar with a first end and a second end and positionable in a normal position and a reverse position;

an indication system;

a support sleeve, affixed within the housing to the first side wall and the opposing second side wall, for receiving and slidably supporting the first end of the point detector bar therewithin;

an orifice defined in the first side wall of the housing, through which the support sleeve is supported by the first side wall, such that the first end of the point detector bar is slidably captivated within said support sleeve within the housing and the second end of the point detector bar is positioned outside of the housing;

a point detector target integrally engaged with the first end of the point detector bar within the housing; and first point detecting means, coupled to the indication system, for detecting said point detector target when the point detector bar is positioned in the normal position, wherein said first point detecting means generates a normal point detection signal that is transmitted to the indication system when said first point detecting means detects said point detector target.

2. The point detection system according to claim 1, further comprising:

first point mounting means for mounting said first point detecting means in slidable proximity to said point detector target, such that said first point detecting means is slidably adjustable relative to said point detector target.

3. The point detection system according to claim 2, further comprising:

a slot defined by said support sleeve, through which said point detector target is detectable by said first detecting means when said point detector bar is positioned within said support sleeve.

4. The point detection system according to claim 3, further comprising:

second point detecting means for detecting said point detector target when the point detector bar is positioned in the reverse position.

5. The point detection system according to claim 4, further comprising:

second point mounting means for mounting said second point detecting means in slidable proximity to said point detector target, such that said second point detecting means is slidably adjustable relative to said point detector target.

6. The point detection system according to claim 5, wherein said first and second detecting means each comprises a proximity sensor and said point detector target comprises a metallic material.

7. The point detection system according to claim 3, further comprising:

a lock box integrally engaged with the slide bar within the housing, with a notched lock rod assembly being cooperatively engaged with said lock box that defines a lock dog for locking movement of the switch machine; and first lock detecting means, coupled to the indication system, for detecting said lock box when the slide bar is positioned in the normal locked position, wherein said first lock detecting means generates a normal locked detection signal that is transmitted to the indication system when said lock box is detected in the normal locked position.

8. The point detection system according to claim 7, further comprising:

second lock detecting means for detecting said lock box in the reverse position.

9. The point detection system according to claim 8, further comprising:

first and second lock mounting means for mounting said first and second lock detecting means, respectively, in slidable proximity to said lock box, such that respective said first and second lock detecting means is slidably adjustable relative to said lock box.

10. The point detection system according to claim 9, wherein said first and second lock detecting means each comprise a proximity sensor and said lock box comprises a metallic material.

11. The point detection system according to claim 9, wherein said point detector target is affixed to said first end of said point detector bar and said lock box is affixed to said slide bar.

12. The point detection system according to claim 9, wherein said point detector target is embedded within said first end of said point detector bar and said lock box is embedded within said slide bar.

13. A point detection system for a railway switch machine, said railway switch machine defining a housing with a first side wall and an opposing second side wall, wherein said point detection system comprises:

a point detector bar with a first and second end, positionable in a normal point position and a reverse point position;

a slide bar cooperatively engaged within the housing with locking means for locking movement of the switch machine, said slide bar being lockable in a normal locked position and a reverse locked position;

a support sleeve affixed within the housing to the first side wall and to the opposing second side wall, for receiving and slidably supporting said first end of the point detector bar therewithin;

an orifice defined in the first side wall of the housing, through which said support sleeve is supported by the first side wall, such that said first end of said point detector bar is slidably captivated within said support sleeve within the housing and said second end of said point detector bar is positioned outside of the housing;

a point detector target integrally engaged with said first end of said point detector bar within the housing;

a lock box integrally engaged with said slide bar within the housing;

first point detecting means for detecting said point detector target when said point detector bar is positioned in said normal point position, wherein said first point detecting means generates a normal point detection signal when said point detector target is detected in said normal point position; and first lock detecting means for detecting said lock box when said slide bar is locked in said normal locked position, wherein said first lock detecting means generates a normal lock detection signal when said first lock detecting means detects said lock box.

14. The point detection system according to claim 13, further comprising:

first point mounting means for mounting said first point detecting means in slidable proximity to said point detector target, such that said first point detecting means is slidably adjustable relative to said point detector target; and first lock mounting means for mounting said first lock detecting means in slidable proximity to said lock box, such that said first lock detecting means is slidably adjustable relative to said lock box.

15. The point detection system according to claim 14, further comprising:

a slot defined by said support sleeve, through which said point detector target is detectable by said first detecting means when said point detector bar is positioned within said support sleeve.

16. The point detection system according to claim 15, wherein each of said point detector target and said lock box comprises a ferrous material and each of said first point detecting means and said first lock detecting means comprises a proximity sensor.

17. The point detection system according to claim 16, wherein said point detector target is affixed to said first end of said point detector bar and said lock box is affixed to said slide bar.

18. The point detection system according to claim 5, further comprising:

track side bearing means, affixed to the first side wall of the switch machine, for supporting said support sleeve and slidably supporting the point detector bar therewithin while the first end of the point detector bar is slidably supported within said support sleeve; and field side bearing means, affixed to the opposing second side wall of the switch machine, for supporting said support sleeve.

19. The point detection system according to claim 18, wherein said track side bearing means is interchangeable between the first side wall and the second opposing side wall of the switch machine, and said field side bearing means is interchangeable between the opposing second side wall and the first side wall of the switch machine.

20. The point detection system according to claim 17, further comprising:

track side bearing means, affixed to the first side wall of the switch machine, for supporting said support sleeve and slidably supporting said point detector bar therewithin while said first end of the point detector bar is slidably supported within said support sleeve; and field side bearing means, affixed to the opposing second side wall of the switch machine, for supporting said support sleeve.

21. The point detection system according to claim 20, wherein said track side bearing means is interchangeable between the first side wall and the opposing second side wall of the switch machine, and said field side bearing means is interchangeable between the opposing second side wall and the first side wall of the switch machine.

22. A point detection system for a railway switch machine, said railway switch machine defining a housing with a first side wall and an opposing second side wall, wherein said point detection system comprises:

a point detector bar with a first and second end, positionable in a normal point position and a reverse point position;

captivating means affixed to said first and second side walls and within the housing, for slidably captivating and retaining said first end of said point detector bar within said captivating means and completely within the housing while said second end of said point detector bar is positioned outside of the housing; and point detecting means for detecting said point detector bar in said normal point position and in said reverse position, wherein said point detecting means generates a normal point detection signal after detecting said point detector bar in said normal point position and said point detecting means generates a reverse point detection signal after detecting said point detector bar in said reverse point position.

23. A point detection system for a railway switch machine, said railway switch machine defining a housing with a first side wall and an opposing second side wall, wherein said point detection system comprises:

a point detector bar with a first and second end, positionable in a normal point position and a reverse point position;

captivating means affixed to and within the housing, for slidably captivating and retaining said first end of said point detector bar within said captivating means while said second end of said point detector bar is positioned outside of the housing, said captivating means comprising:

a support sleeve affixed within the housing to the first side wall and to the opposing second side wall, for receiving and slidably supporting said first end of the point detector bar therewithin, and an orifice defined in the first side wall of the housing, through which said support sleeve is supported by the first side wall; and point detecting means for detecting said point detector bar in said normal point position and in said reverse position, wherein said point detecting means generates a normal point detection signal after detecting said point detector bar in said normal point position and said point detecting means generates a reverse point detection signal after detecting said point detector bar in said reverse point position.

24. The point detection system according to claim 23, wherein said point detecting means comprises:

a point detector target integrally engaged with said first end of said point detector bar within the housing;

a normal point sensor for sensing said point detector target when said point detector bar is positioned in said normal point position;

a normal point signal generator electrically coupled to said normal point sensor for generating said normal point detection signal;

a reverse point sensor for sensing said point detector target when said point detector bar is positioned in said reverse point position; and a reverse point signal generator electrically coupled to said reverse point sensor for generating said reverse point detection signal.

25. The point detection system according to claim 24, further comprising:

locking means for locking movement of the switch machine, said locking means being lockable in a normal locked position and a reverse locked position; and lock detecting means for detecting said locking means in said normal locked position and in said reverse locked position, wherein said lock detecting means generates a normal lock detection signal after detecting said locking means in said normal locked position and said lock detecting means generates a reverse lock detection signal after detecting said locking means in said reverse locked position.

26. The point detection system according to claim 25, wherein said locking means comprises:

a lock rod assembly, positioned substantially perpendicular to the first side wall and the opposing second side wall of the switch machine housing, wherein said lock rod assembly defines a normal locking notch and a reverse locking notch;

a slide bar positioned substantially perpendicular to said lock rod assembly and slidable within the switch machine housing;

a lock box affixed to said slide bar, wherein said lock box defines a normal locking dog that cooperatively mates with said normal locking notch to lock said lock box in said normal locked position and wherein said lock box defines a reverse locking dog that cooperatively mates with said reverse locking notch to lock said lock box in said reverse locked position.

27. The point detection system according to claim 26, wherein said lock detecting means comprises:

a lock detector target integrally engaged with said lock box;

a normal lock sensor for sensing said lock detector target when said lock box is locked in said normal locked position;

a normal signal generator electrically coupled to said normal sensor for generating said normal point detection signal;

a reverse sensor for sensing said lock detector target when said lock box is positioned in said reverse locked position; and a reverse signal generator electrically coupled to said reverse sensor for generating said reverse point detection signal.

28. The point detection system according to claim 27, further comprising:

normal point mounting means for mounting said normal point sensor in slidable proximity to said point detector target, such that said normal point sensor is slidably adjustable relative to said point detector target; and normal lock mounting means for mounting said normal lock sensor in slidable proximity to said lock detector target, such that said normal lock sensor is slidably adjustable relative to said lock detector target.

29. The point detection system according to claim 28, further comprising:

reverse point mounting means for mounting said reverse point sensor in slidable proximity to said point detector target, such that said reverse point sensor is slidably adjustable relative to said point detector target; and reverse lock mounting means for mounting said reverse lock sensor in slidable proximity to said lock detector target, such that said reverse lock sensor is slidably adjustable relative to said lock detector target.

30. The point detection system according to claim 23, further comprising:

a slot defined by said support sleeve, through which said point detector target is detectable by said point detecting means when said point detector bar is positioned within said support sleeve.

31. The point detection system according to claim 27, wherein each of said point detector target and said lock detector target comprises a ferrous material and each of said normal point sensor and said normal lock sensor comprises a proximity sensor.

32. The point detection system according to claim 25, further comprising:

track side bearing means, affixed to the first side wall of the switch machine, for supporting said support sleeve and slidably supporting the point detector bar therewithin while the first end of the point detector bar is slidably supported within said support sleeve; and field side bearing means, affixed to the opposing second side wall of the switch machine, for supporting said support sleeve.

33. The point detection system according to claim 32, wherein said track side bearing means is interchangeable between the first side wall and the opposing second side wall of the switch machine, and said field side bearing means is interchangeable between the opposing second side wall and the first side wall of the switch machine.

* * * * *